US005203176A

United States Patent [19]

De Weered

[11] Patent Number: 5,203,176

[45] Date of Patent: Apr. 20, 1993

[54] METHODS AND DEVICE FOR PREPARING ICE

[75] Inventor: Marinus C. De Weered, Haaksbergen, Netherlands

[73] Assignee: S.S.P. Lichtenvoorde B.V., Lichtenvoorde, Netherlands

[21] Appl. No.: 718,182

[22] Filed: Jun. 20, 1991

[30] Foreign Application Priority Data

Jun. 21, 1990 [NL] Netherlands ..... 9001429

[51] Int. Cl.[5] ..... F25C 1/12

[52] U.S. Cl. ..... 62/138; 62/352

[58] Field of Search ..... 62/138, 73, 352, 81, 62/156, 278

[56] References Cited

U.S. PATENT DOCUMENTS

| | | | |
|---|---|---|---|
| 3,107,500 | 10/1963 | Cood | 62/156 |
| 3,430,482 | 3/1969 | Dedricks et al. | 62/138 |
| 3,822,564 | 7/1974 | Nijo | 62/156 |
| 4,122,686 | 10/1978 | Lindahl et al. | 62/278 X |
| 4,192,151 | 3/1980 | Carpenter | 62/320 |
| 4,357,807 | 11/1982 | Aleksandrow | 62/228 |
| 4,648,247 | 3/1987 | Takizawa et al. | 62/256 |
| 4,829,782 | 5/1989 | Mueller et al. | 62/347 |

FOREIGN PATENT DOCUMENTS

| | | |
|---|---|---|
| 0213540 | 3/1987 | European Pat. Off. . |
| 2167543 | 5/1986 | United Kingdom . |

*Primary Examiner*—William E. Tapolcai

*Attorney, Agent, or Firm*—Webb, Burden, Ziesenheim & Webb

[57] ABSTRACT

Methods are disclosed for preparing ice, comprising guiding a liquid (22) over an evaporator (11, 12) of a refrigerating circuit (1), heating the evaporator (11, 12) at a determined moment, and collecting ice removed from the evaporator (11, 12). These methods are characterized in that the heating time and the freezing time are governed by the presence and thickness of ice on the evaporator (11, 12), respectively. Also a device for performing these methods is described, comprising a refrigerant condition sensor (28) arranged in the refrigerating circuit (1).

8 Claims, 1 Drawing Sheet

METHODS AND DEVICE FOR PREPARING ICE

Figure 1:
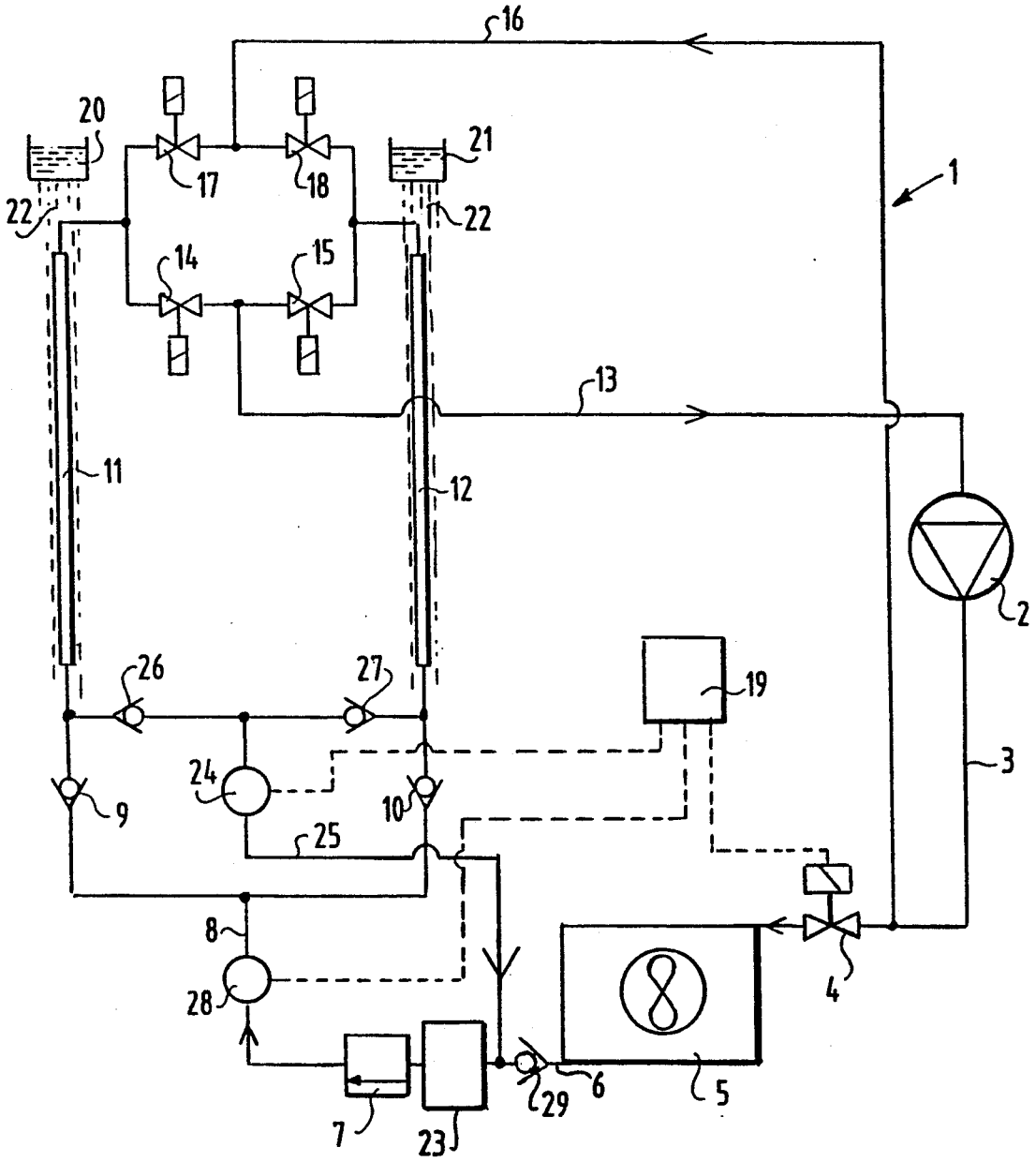

The present invention relates to methods for preparing ice, comprising guiding a liquid over an evaporator of a refrigerating circuit, heating the evaporator at a determined moment and collecting ice removed from the evaporator and to a device for performing these methods. Such methods and a device for performing thereof are known, for example from U.S. Pat. No. 4,192,151.

Known from this publication is the preparing of ice by guiding liquid for a determined time over an evaporator of a refrigerating circuit, which has the form of a number of vertical flat plates, until the formed ice layer is thick enough and subsequently defrosting the formed ice from the evaporator by heating the evaporator for a period of time by guiding hot gas from a compressor of the refrigerating circuit through the evaporator plates. The side of the ice adhering to the evaporator plates is thus thawed and the ice releases from the evaporator plates, whereafter it is collected in a grinding device in which it is ground to small pieces.

Ice can be prepared in this manner simply and rapidly in large quantities. This is important for example in bringing fresh products of a perishable nature to storage temperature. It is of great importance for instance for the shelf-life of fresh milk that is cooled as quickly as possible from the temperature corresponding with the body temperature of the milk-providing animal to a temperature of a few degrees above freezing point. large quantities of ice are required for this purpose at the moment of milking of the diary animal. Because this ice can be prepared quickly in the above described manner, the great exertion involved in the storage of ice are not necessary.

The above described method for preparing ice has the drawback however that the moment at which freezing ends and heating starts is controlled by an adjustable timer and must be pre-selected. The selection of this moment, and therefore of this freezing time, will usually be made on the basis of experience, wherein it will generally be ensured that the freezing time is selected to be of a length such that sufficient ice is formed under all conditions. In favourable conditions, wherein the compressor attains a relatively large refrigerating capacity, a thicker layer of ice will therefore be formed on the evaporator than desired, whereby the efficiency of the ice preparation will be greatly reduced. This occurs in the case of air-cooled compressors when the ambient temperature is lower than the maximum anticipated ambient temperature.

The present invention therefore has for its object to provide a method for preparing ice as described above, wherein the above stated drawback is avoided. This is achieved according to the invention in that the thickness of the ice on the evaporator is detected and the moment of heating is determined by the detected thickness of the ice on the evaporator. Precisely the desired ice thickness is thus obtained under all conditions.

In preference the moment of heating is determined in that the pressure of a refrigerant present in the refrigerating circuit falls below a determined value after expansion in an expansion valve included in the refrigerating circuit. This pressure falls away sharply when the thickness of the ice layer approaches an unfavorable value from an energy point of view and therefore forms a very clear indication of the most desirable defrosting moment.

The most of heating can also be determined in that the temperature of a refrigerant present in the refrigerating circuit falls below a determined value after expansion in an expansion value included in the refrigerating circuit. This temperature likewise falls sharply when the ice thickness approaches an unfavourable value from an energy point of view and so likewise forms a good indicator for the defrosting moment.

When the refrigerating circuit has at least two evaporators, from only one of which at a time the ice is defrosted, wherein the evaporator from which the ice is thawed is connected during the defrosting to other parts of the refrigerating circuit such that it functions as condenser in the refrigerating circuit, the ice preparation can proceed continuously because the ice can be thawed alternately from one of the evaporators.

In addition to the drawbacks mentioned before, the method for preparing ice known from U.S. Pat. No. 4,192,151 has the drawback that the duration of the heating, just as the freezing time, is controlled by an adjustable timer and has to be pre-selected. The heating time will generally be selected to be of a length such that all the ice will be removed from the evaporator under all conditions. This results in high energy consumption and in most cases an unnecessarily long interruption of the ice preparation.

It is further noted that an ice preparing method is known from U.S. Pat. No. 4,357,807 wherein heating of the evaporator plates is ended by a microswitch being thrown by the ice falling from the plates. Such a switch does not however function sufficiently reliably in the ambient conditions prevailing during ice preparation.

The present invention therefore further has as its object to provide a method for preparing ice as described above wherein these drawbacks are avoided. This is achieved according to the invention in that the presence of ice on the evaporator is detected and heating is ended when ice is absent from the evaporator. Thus achieved is a rapid and efficient ice preparation. The detecting of the absence of ice on the evaporator can take place in different ways.

Heating is preferably ended when the pressure of a refrigerant present in the refrigerating circuit exceeds a determined value after condensation in the evaporator from which the ice is thawed. Heating can also be ended when the temperature of a refrigerant present in the refrigerating circuit exceeds a determined value after condensation in the evaporator from which the ice is thawed. It is the case that both the condensation pressure and the condensation temperature of the refrigerant rise sharply when the ice is released from the evaporator and the refrigerant can thus no longer give off its heat thereto. The condensation pressure and temperature therefore both form a clear indication of the absence of ice on the evaporator.

The invention further has for its object to provide a device for preparing ice with which the above described methods can be performed. In a device comprising a refrigerating circuit with at least one compressor, at least one condenser connected to the delivery side of the compressor over a first conduit having therein a first controllable valve, at least one expansion valve connected to the condenser over a second conduit, at least one evaporator connected to the expansion valve over a third conduit having therein a first check valve, a return line connecting the evaporator to the suction side of the compressor and having therein a second controllable valve, a defrosting conduit connecting the delivery side of the compressor to the evaporator and having therein a third controllable valve, and means for controlling the valves; means for guiding a liquid for freezing over the evaporator; and means for collecting ice formed on the evaporator, this is achieved according to the invention by a condition sensor arranged in the third conduit and connected for signal transmission to the valve control means. The condition sensor may be a pressure sensor or a temperature sensor.

In preference a device according to the invention comprises a number of evaporators arranged mutually in parallel in the refrigerating circuit, each of which is connected to the second conduit over a fourth conduit having therein a second check valve. The ice can thus be thawed from one of the evaporators at a time, wherein the evaporator from which the ice is thawed functions as condenser of the refrigerating circuit during the thawing.

When the device according to the invention comprises a condition sensor arranged in the fourth conduit and connected for signal transmission to the valve control means, defrosting can be ended at precisely that moment when virtually no more ice is detected on the evaporator.

Mentioned and other features of the methods and device according to the invention are elucidated hereinafter on the basis of an example wherein reference is made to the annexed figure which shows a schematic diagram of a preferred embodiment of the device for performing the methods according to the invention.

A device for preparing ice comprises a refrigerating circuit 1, means 20, 21 which distribute a liquid 22 for freezing over evaporators 11, 12 of the refrigerating circuit 1 and means for collecting the ice formed on the evaporators 11, 12. The refrigerating circuit 1 comprises a compressor 2, a condenser 5 connected to the delivery side thereof over a first conduit 3 having therein a first controllable valve 4, an expansion valve 7 connected to the condenser 5 over a second conduit 6, two evaporators 11, 12 connected to the expansion valve 7 over a third conduit 8 having therein first check valves 9, 10, a return line 13 connecting the evaporators 11, 12 to the suction side of the compressor 2 and having therein second controllable valves 14, 15, and a defrosting conduit 16 connecting the delivery side of the compressor 2 to the evaporators 11, 12 and having therein third controllable valves 17, 18. A storage tank 23 present in the second conduit 6 ensures that in all conditions a suitable quantity of refrigerant circulates through the circuit 1.

During preparation of ice a refrigerant is compressed by the compressor 2 and pumped round in the refrigerating circuit 1. The refrigerant is pumped through the first conduit 3, through the open first controllable valve 4 to the condenser 5, where it condenses. The condensed refrigerant then flows to the expansion valve 7, where it expands. Via the third conduit 8 the expanded refrigerant flows through the first check valves 9, 10 to the evaporators 11, 12. In the evaporators 11, 12 the refrigerant is evaporated. The evaporating heat required herefor is extracted from the air surrounding the evaporators 11, 12 whereby the liquid 22 flowing over the evaporators 11, 12 freezes and an ice layer is formed on the evaporators 11, 12. The refrigerant vapour is subsequently drawn via the opened second controllable valves 14, 15 through the return line 13 to the compressor.

As the thickness of the ice layer on the evaporators 11, 12 increases, the pressure and temperature of the refrigerant in the third conduit 8 falls. This is detected by a pressure or temperature sensor 28 which, when the pressure or temperature falls below a determined value, generates a signal to valve control means 19. In other words, the sensor 28 senses a thermodynamic parameter, such as pressure or temperature, of the refrigerating circuit refrigerant. When the valve control means 19 receive this signal they close the first controllable valve 4, the second controllable valve 14 and open the third controllable valve 17. The feed of liquid 22 for freezing to the first evaporator 11 is thereafter stopped with a time delay.

The refrigerant at high temperature compressed in the compressor 2 is now fed via the defrosting conduit 16 to the first evaporator 11, which functions as condenser in the now formed refrigerating circuit, and condenses therein. The condensed refrigerant then flows through a fourth conduit 25 via a second check valve 26 arranged therein to the second conduit 6 and, after being expanded in the expansion valve 7, flows via the third conduit 8 and the first check valve 10 through the second evaporator 12. A check valve 29 arranged in the second conduit 6 prevents the condensed refrigerant from flowing inside the condenser 5. The refrigerant evaporates in the second evaporator 12, whereafter the refrigerant vapour is carried again via the controllable valve 15 through the return line 13 to the compressor 2. The side of the ice layer present on the first evaporator 11 and adhered thereto is thus thawed, whereby the ice layer is released from the evaporator 11 and falls under the influence of the force of gravity into collecting means not shown here.

When the ice has been released from the first evaporator 11 the refrigerant flowing through the first evaporator 11 acting as condenser can no longer get rid of its heat effectively, the more so as there is also no liquid 22 flowing over the first evaporator 11, whereby the condensation temperature and the related condensation pressure of the refrigerant increase. This is detected by a temperature or pressure sensor 24 which is arranged in the fourth conduit 25 and which, when the condensation temperature or pressure exceeds a determined value, generates a signal to the valve control means 19 that the thawing is completed. The valve control means 19 then close the third controllable valve 17 and open the first controllable valve 4 and the second controllable valve 14. The supply of liquid 22 to the first evaporator 11 is also re-started.

Ice preparation now takes place further in the above described manner, wherein, when the pressure or temperature sensor 28 again detects a pressure fall or temperature fall, the second evaporator 12 is now defrosted by closing the first controllable valve 4 and the second controllable valve 15 and opening the third controllable valve 18. The liquid flow 22 over the second evaporator 12 is further turned off after a time delay.

In this manner ice preparation can proceed continuously, while the formed ice is defrosted alternately from the first and second evaporators 11, 12.

The desired ice thickness and the desired degree of defrosting can be set by adjusting the pressure or temperature sensor 28 and the temperature or pressure sensor 24 to the appropriate signal values.

I claim:

1. A device for making ice, comprising:

a refrigerating circuit (1) adapted to contain a refrigerant with at least one compressor (2) at least one condenser (5) connected to the delivery side of the compressor (2) by a first conduit (3) having therein a first controllable valve (4) at least one expansion valve (7) connected to the condenser (5) by a second conduit (6) at least one evaporator (11, 12) connected to the expansion valve (7) by a third conduit (8) having therein a first check valve (9, 10), a return line (13) connecting the evaporator (11, 12) to the suction side of the compressor (2) and having therein a second controllable valve (14, 15), a defrosting conduit (16) connecting the delivery side of the compressor (2) to the evaporator (11, 12) and having therein a third controllable valve (17, 18), and means (19) for controlling the valves;

means (20, 21) for guiding a liquid (22) for freezing over the evaporator (11, 12);

means for collecting ice formed on the evaporator (11, 12); and a condition sensor (28) for sensing a thermodynamic parameter of the refrigerant arranged in the third conduit (8) and connected for signal transmission to the valve control means (19).

2. A device as claimed in claim 1, wherein the condition sensor (28) is a pressure sensor.

3. A device as claimed in claim 1, wherein the condition sensor (28) is a temperature sensor.

4. A device as claimed in claim 1, wherein a plurality of evaporators (11, 12) are arranged mutually in parallel in the refrigerating circuit (1), each of which is connected to the second conduit (6) by a fourth conduit (25) having therein a second check valve (26, 27).

5. A device as claimed in claim 4, further comprising a condition sensor (24) arranged in the fourth conduit (25) and connected for signal transmission to the valve control means (19).

6. The device for making ice as claimed in claim 1, wherein the thermodynamic parameter is selected from the group consisting of a pressure of the refrigerating circuit refrigerant and a temperature of the refrigerating circuit refrigerant.

7. A method of preparing ice utilizing a refrigerating circuit (1) adapted to contain a refrigerant with at least one compressor (2) at least one condenser (5) connected to the delivery side of the compressor (2) by a first conduit (3) having therein a first controllable valve (4) at least one expansion valve (7) connected to the condenser (5) by a second conduit (6) at least one evaporator (11, 12) connected to the expansion valve (7) by a third conduit (8) having therein a first check valve (9, 10), a return line (13) connecting the evaporator (11, 12) to the suction side of the compressor (2) and having therein a second controllable valve (14, 15), a defrosting conduit (16) connecting the delivery side of the compressor (2) to the evaporator (11, 12) and having therein a third controllable valve (17, 18), and means (19) for controlling the valves, and a condition sensor (28) for sensing a thermodynamic parameter of the refrigerant arranged in the third conduit (8) and connected for signal transmission to the valve control means (19), further comprising the steps of:

guiding a liquid (22) for freezing over said evaporator with means (20, 21) for guiding said liquid (22) for freezing over said evaporator (11, 12) ;

detecting the thickness of the ice on said evaporator;

heating the evaporator (11, 12) at a determined moment, which is determined by the detected thickness of said ice on said evaporator; and collecting ice removed from said evaporator with means for collecting ice formed on the evaporator (11, 12).

8. The device for making ice as claimed in claim 7, wherein the thermodynamic parameter is selected from the group consisting of a pressure of the refrigerating circuit refrigerant and a temperature of the refrigerating circuit refrigerant.

* * * * *